US009710989B2

(12) United States Patent
Matsuoka

(10) Patent No.: US 9,710,989 B2
(45) Date of Patent: Jul. 18, 2017

(54) AUTOMATIC TELLER MACHINE

(71) Applicant: Oki Electric Industry Co., Ltd., Tokyo (JP)

(72) Inventor: Gentaro Matsuoka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/648,408

(22) PCT Filed: Oct. 7, 2013

(86) PCT No.: PCT/JP2013/077267
§ 371 (c)(1),
(2) Date: May 29, 2015

(87) PCT Pub. No.: WO2014/087732
PCT Pub. Date: Jun. 12, 2014

(65) Prior Publication Data

US 2015/0310690 A1 Oct. 29, 2015

(30) Foreign Application Priority Data

Dec. 5, 2012 (JP) ..... 2012-266261

(51) Int. Cl.
*G07F 7/04* (2006.01)
*G07D 11/00* (2006.01)
(Continued)

(52) U.S. Cl.
CPC ..... *G07D 11/0012* (2013.01); *B65H 5/066* (2013.01); *G07D 13/00* (2013.01);
(Continued)

(58) Field of Classification Search
CPC ..... E05D 2005/102; E05D 2005/104; E05D 2005/106; E05D 2005/108;
(Continued)

(56) References Cited

U.S. PATENT DOCUMENTS 4,516,867 A * 5/1985 Schacht ..... B41J 3/38 400/134
6,089,675 A * 7/2000 Schlanger ..... B60B 27/023 280/279
(Continued)

FOREIGN PATENT DOCUMENTS

CA 2312937 A1 4/2000
CN 1727194 A 2/2006
(Continued)

*Primary Examiner* — Jeffrey Shapiro
(74) *Attorney, Agent, or Firm* — Rabin & Berdo, P.C.

(57) ABSTRACT

An automatic teller machine includes a guide, shafts and rollers. The guide extends in a conveyance direction along which papers are conveyed and includes a conveyance surface on which the papers are conveyed. The shafts are retained in the guide, and the rollers are turnably supported by the shafts. The guide includes a roller slot in which the rollers are disposed, and pairs of shaft slots that are opposingly formed to sandwich the roller slot. Each pair of shaft slots retains two ends of one of the shafts. The guide may include protrusion portions in the shaft slots that protrude in a direction orthogonal to the conveyance surface, and the shafts may include holes through which the protrusion portions are inserted when the shafts are retained in the shaft slots. Projection portions may be formed at the guide, projecting from predetermined positions of inner faces of the shaft slots, and the projection portions may abut against the shafts when the shafts are retained in the shaft slots.

3 Claims, 12 Drawing Sheets

(51) Int. Cl.
*B65H 5/06* (2006.01)
*G07F 19/00* (2006.01)
*G07D 13/00* (2006.01)

(52) U.S. Cl.
CPC ..... *G07F 19/203* (2013.01); *B65H 2404/15* (2013.01); *B65H 2404/52131* (2013.01); *B65H 2404/54* (2013.01); *B65H 2701/1912* (2013.01)

(58) Field of Classification Search
CPC ..... E05D 2005/122; E05D 2005/124; E05D 5/10; E05D 5/12; E05D 5/121; E05D 5/125; E05D 5/127; E05D 5/128; E05D 7/1005; Y10T 403/7039; Y10T 403/553; G07D 11/0006; G07D 11/0009; G07D 11/0012; G07D 11/0015
USPC ..... 194/206, 207, 350; 209/534; 235/379; 16/386; 403/361, 268, 263, 244, 165; 464/50, 104, 105, 180, 184; 902/13
See application file for complete search history.

(56) References Cited

U.S. PATENT DOCUMENTS 6,257,569 B1* 7/2001 Rhodes ..... B65H 3/0669 271/10.03
6,398,108 B1 6/2002 Swinton et al.
6,857,631 B2 2/2005 Morrison et al.
2001/0028146 A1* 10/2001 Takata ..... B65H 5/062 271/274
2004/0016798 A1* 1/2004 Saltsov ..... G07D 11/0018 235/379
2004/0118657 A1* 6/2004 Kallin ..... G07F 19/20 194/207
2004/0154900 A1* 8/2004 Blaser ..... B65H 3/5215 194/206
2005/0045449 A1* 3/2005 Nago ..... B65H 9/101 194/207
2006/0070840 A1* 4/2006 Hayashi ..... B65H 9/166 194/206
2006/0225986 A1* 10/2006 Oishi ..... B65H 5/28 194/203
2008/0163726 A1* 7/2008 Wente ..... B25G 1/043 81/177.2
2009/0302112 A1* 12/2009 Segawa ..... G07G 1/0018 235/449
2013/0134667 A1* 5/2013 Nakayama ..... B65H 5/06 271/275

FOREIGN PATENT DOCUMENTS

JP S62-167149 A 7/1987
JP H04-42150 U 4/1992
JP H09-221246 A 8/1997
JP 2006-290513 A 10/2006
JP 2010-083670 A 4/2010
JP 2012-106817 A 6/2012
RU 2338048 C2 11/2008
RU 2008-126708 A 1/2010

* cited by examiner

AUTOMATIC TELLER MACHINE

TECHNICAL FIELD

The present invention relates to an automatic teller machine (ATM) and relates to, for example, a machine that handles papers such as banknotes or the like.

BACKGROUND ART

Conventionally, as illustrated in FIG. 8A, FIG. 8B, FIG. 8C and FIG. 9, a thin plate-shaped guide 202 is provided in a conveyance path 200 of an ATM. The guide 202 is fixed so as to span between frames 201 that are opposingly disposed.

The conveyance path 200 conveys papers (banknotes) on a conveyance surface 202A, which is one face of the guide 202. Roller holes 202B are provided in the conveyance surface 202A of the guide 202. Portions of rollers 203 protrude through the roller holes 202B.

Shafts 204 span between the frames 201 at a side face of the guide 202 of the conveyance path 200 that is at the opposite side of the guide 202 from the side at which the conveyance surface 202A is provided, with bearings 205 interposed between the shafts 204 and the frames 201. Each shaft 204 is fixed at both ends by screws 207.

Each roller 203 is disposed in correspondence with a roller hole 202B and fixed to the shaft 204 by a pin 206. A portion of the roller 203 protrudes above the conveyance surface 202A of the guide 202. The rollers 203 turn with the shaft 204 (for example, see Japanese Patent Application Laid-Open (JP-A) No. 2010-83670).

SUMMARY OF INVENTION

Technical Problem

However, in the conveyance path 200 described above, because the shafts 204 span between the frames 201, the length of the shafts 204 is determined by a distance between the frames 201. Thus, it is difficult to make the shafts 204 shorter.

Further, because spaces between the rollers 203 and the frames 201 are occupied by the shafts 204, it is difficult to dispose, for example, sensors and the like to the sides of the rollers 203.

In consideration of the points mentioned above, the present invention proposes an automatic teller machine in which shafts may be made shorter than in related art of a conveyance path that conveys papers on a conveyance surface.

Solution to Problem

To solve the problem described above, the present invention includes: a guide that extends in a conveyance direction along which papers are conveyed and that includes a conveyance surface on which the papers are conveyed; a shaft that is retained at the guide; and a roller that is turnably retained at the shaft, wherein the guide includes: a roller slot in which the roller is disposed; and a pair of shaft slots opposingly formed to sandwich the roller slot, the shaft slots respectively retaining two ends of the shaft.

Thus, because the shaft slots are formed at the opposing positions sandwiching the roller slot, which matches the width of the roller, and the shaft supporting the roller is retained between the shaft slots, the shaft length may be made shorter than in related art of a conveyance path that conveys papers on a conveyance surface.

Advantageous Effects of Invention

According to the present invention, shaft lengths may be made shorter than in related art of a conveyance path that conveys papers on a conveyance surface, by shaft slots being formed at opposing positions that sandwich roller slots that match the width of rollers and shafts that support the rollers being retained between the shaft slots.

DESCRIPTION OF EMBODIMENTS

Herebelow, embodiments for carrying out the invention are described in detail using the attached drawings.

1. First Embodiment

1-1. Overall Structure of an Automatic Teller Machine

Figure 1:
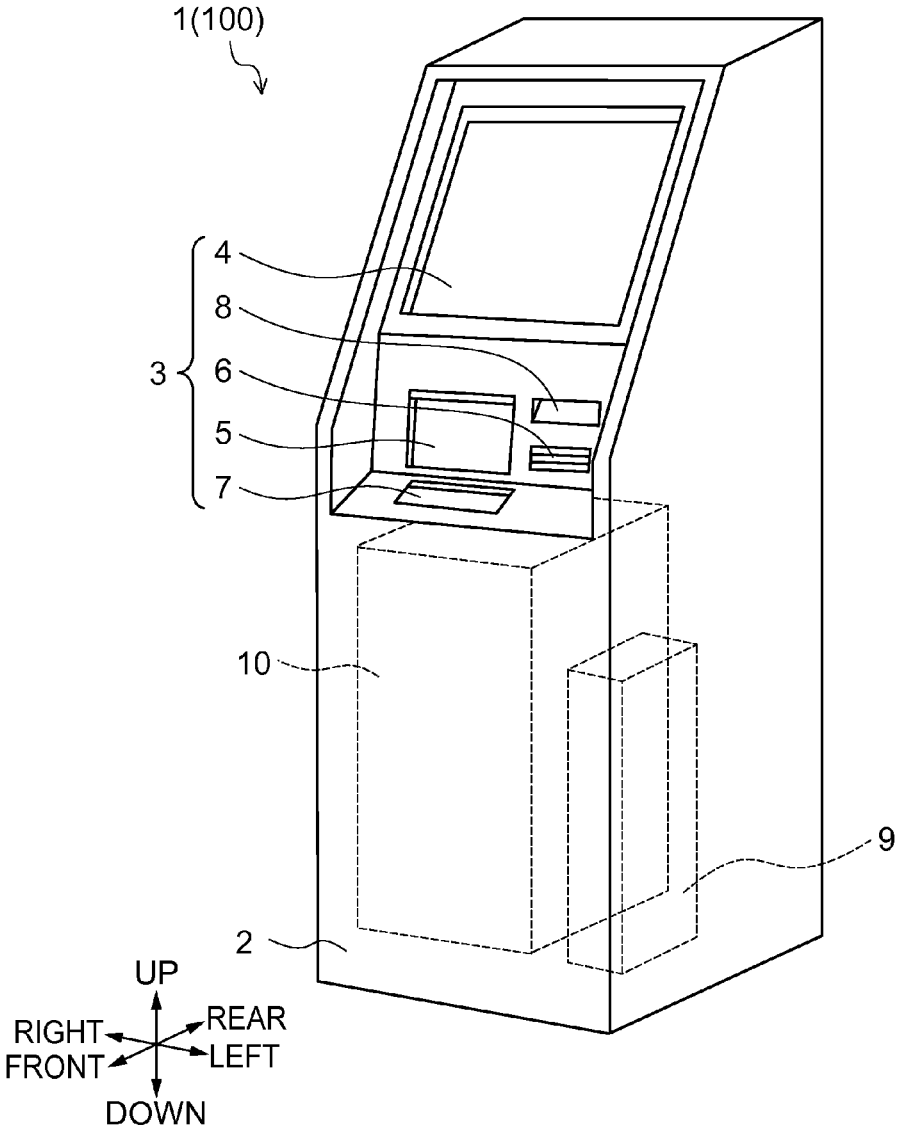
FIG. 1 is a line drawing showing the structure of an ATM.
Figure 2:
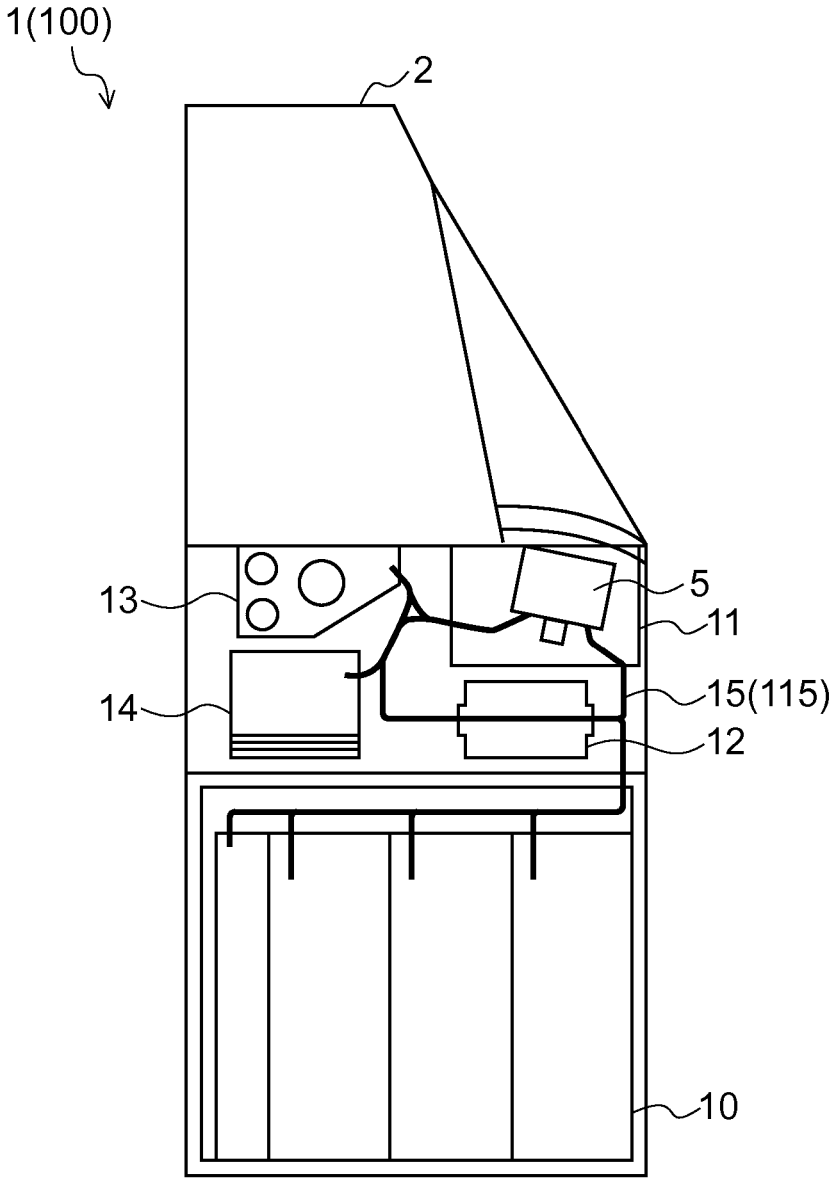
FIG. 2 is a line drawing showing internal structures of the ATM.
Figure 3:
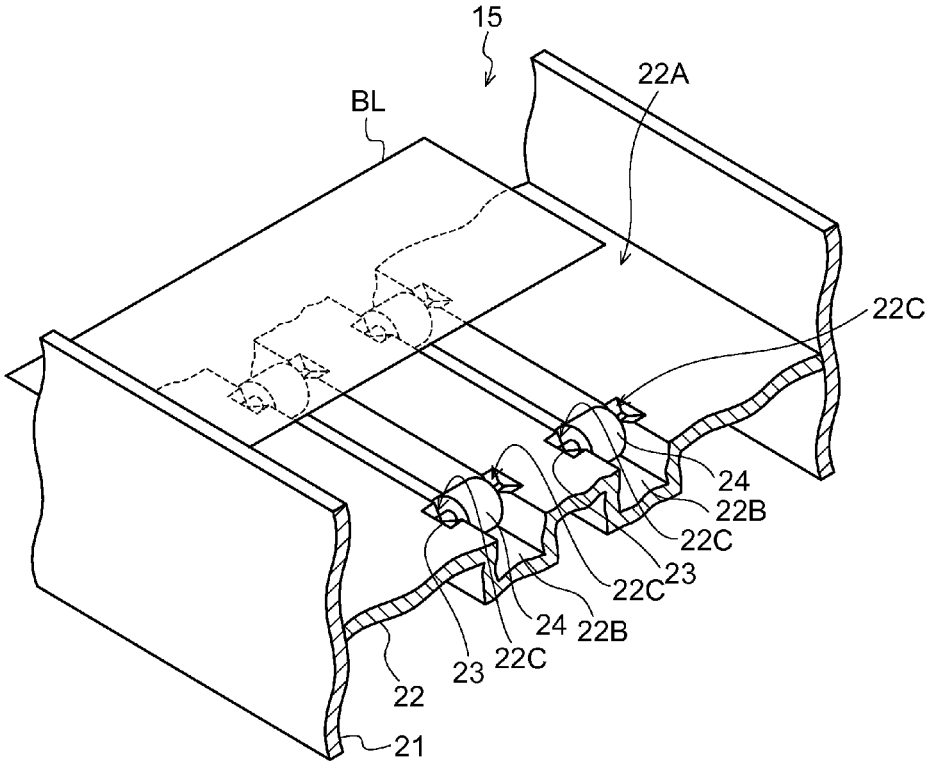
FIG. 3 is a line drawing showing structures (1) of a conveyance path in accordance with a first embodiment.
Figure 4A:
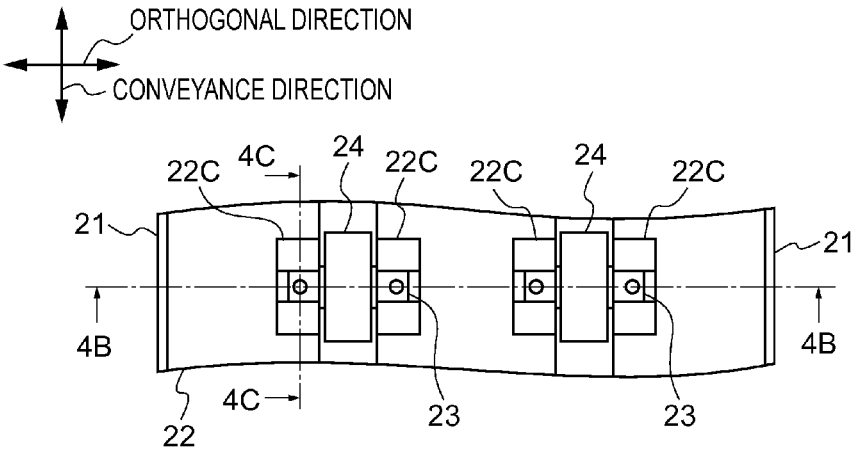
FIG. 4A is a line drawing showing structures (2) of the conveyance path in accordance with the first embodiment.
Figure 4B:
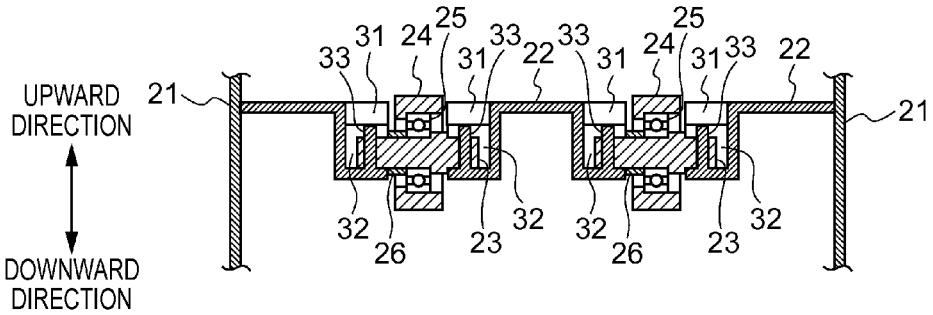
FIG. 4B is a line drawing showing the structures (2) of the conveyance path in accordance with the first embodiment.
Figure 4C:
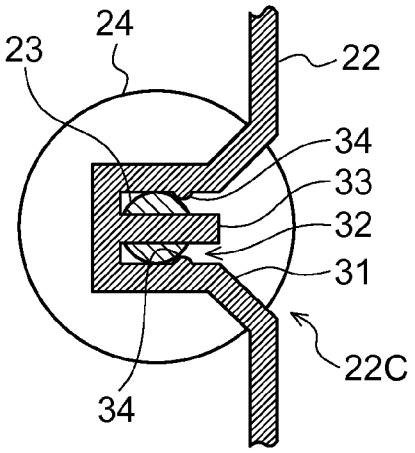
FIG. 4C is a line drawing showing the structures (2) of the conveyance path in accordance with the first embodiment.
Figure 4D:
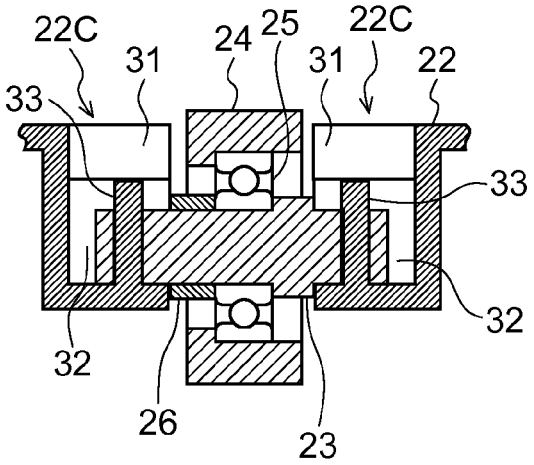
FIG. 4D is a line drawing showing the structures (2) of the conveyance path in accordance with the first embodiment.

First, a first embodiment is described. The structure of an ATM 1 is shown in FIG. 1 and FIG. 2. FIG. 1 shows overall structure of the ATM 1. FIG. 2 shows a side view in which the ATM 1 of FIG. 1 is viewed in a left-and-right direction. Of internal structures of the ATM 1, FIG. 2 principally shows portions relating to the processing of banknotes.

The ATM 1 is provided with a customer service section 3 at a front face of a casing 2. The customer service section 3 includes an operation and display unit 4, a deposit and withdrawal aperture 5, a card insertion and ejection aperture 6, a ten-key pad 7 and a receipt issue aperture 8.

The operation and display unit 4 is structured with a display section and a touch panel. The display section is, for example, a liquid crystal display, an electroluminescent display or the like that displays images of transaction details to customers during transaction operations. The touch panel receives operational inputs by customers. The deposit and withdrawal aperture 5 is an insertion and ejection aperture for banknotes being given and received to and from customers.

The card insertion and ejection aperture 6 is a section at which various cards such as cash cards and the like are inserted and ejected. A card processing section is disposed behind the card insertion and ejection aperture 6. The card processing section reads account numbers and the like that are magnetically recorded on the various cards.

The ten-key pad 7 is a section at which customers input PIN numbers and the like in response to transaction detail screens displayed at the operation and display unit 4. The receipt issue aperture 8 is a section from which receipts on which transaction details are printed are issued.

Inside the casing 2, the ATM 1 is provided with a main control section 9, a storage section 10, a deposit and withdrawal section 11, a verification section 12, a temporary holding section 13, a reject vault 14, a conveyance path 15, and so forth. Banknotes are conveyed, in the direction of the short sides thereof, between the various sections via the conveyance path 15, which is shown by heavy lines in the drawings.

The main control section 9 includes a microcomputer, a memory section and an interface section, and controls the various sections. The microcomputer includes a CPU (central processing unit), RAM (random access memory), ROM (read-only memory) and the like. The memory section is a hard disk drive or the like. The interface section is a connection port to a host computer.

The storage section 10 stores banknotes deposited by customers and banknotes to be paid out to customers, separated by denominations. The deposit and withdrawal section 11 is a section that gives and receives banknotes to and from customers. At times of deposits, the deposit and withdrawal section 11 deposits banknotes, which serve as a medium. At times of withdrawals, the deposit and withdrawal section 11 pays out banknotes stored in the storage section 10 to the customers.

The verification section 12 determines the denominations and authenticity of banknotes being conveyed along the conveyance path 15. The temporary holding section 13 temporarily retains banknotes being passed to and from customers. The reject vault 14 recovers banknotes that are identified by the verification section 12 as being unsuitable for deposit or withdrawal.

When the ATM 1 is conducting, for example, a deposit transaction in which a customer deposits banknotes, a predetermined operation instruction is received via the operation and display unit 4 in accordance with control by the main control section 9, after which the banknotes are inserted at the deposit and withdrawal section 11.

Then, the main control section 9 conveys the inserted banknotes via the conveyance path 15 to the verification section 12. Banknotes that are verified as being proper banknotes are conveyed to the temporary holding section 13 and temporarily held, whereas banknotes that are verified as not suitable for the transaction are conveyed to the deposit and withdrawal section 11 and returned to the customer.

Then, via the operation and display unit 4, the main control section 9 prompts the customer to confirm the deposited value. The banknotes being held in the temporary holding section 13 are again conveyed to the verification section 12 and their denominations are re-verified, and the banknotes are conveyed to and stored in cassettes of the storage section 10 in accordance with the verified denominations.

1-2. Structure of the Conveyance Path

Now, the structure of the conveyance path 15 is described using FIG. 3, FIG. 4A to FIG. 4D, and FIG. 5. FIG. 3 and FIG. 4A to FIG. 4D show portions of the conveyance path 15 as required for description. In practice, further rollers are provided at positions opposing rollers 24 of the conveyance path 15. Banknotes BL are nipped and conveyed by these rollers.

In FIG. 3 and FIG. 4A to FIG. 4D, the direction in which the banknotes BL are conveyed is described as "the conveyance direction", a direction orthogonal to the conveyance direction in a conveyance surface 22A on which the banknotes BL are conveyed is described as "the orthogonal direction", and a direction orthogonal to the conveyance surface 22A is referred to as "the up-and-down direction".

The conveyance path 15 is provided with frames 21 that are opposingly spaced apart, matching a long side direction length of the banknotes BL. The frames 21 extend along the conveyance direction. The conveyance path 15 is also provided with thin plate-shaped guides 22 that are fixed so as to span between the opposingly disposed frames 21. The guides 22 extend along the conveyance direction.

The conveyance path 15 conveys the banknotes BL on the conveyance surface 22A, which is one face of the guides 22. In each guide 22, recess-shaped roller slots 22B are formed as a pair along the conveyance direction, so as to be sunken in the up-and-down direction in the direction toward the face at the opposite side of the guide 22 from the conveyance surface 22A (hereinafter referred to as "the downward direction"). In the roller slots 22B, the rollers 24 are disposed at constant intervals in the conveyance direction.

Shaft slots 22C are formed in the guide 22 at the positions at which the rollers 24 are disposed. The shaft slots 22C oppose one another in the orthogonal direction, sandwiching the roller slots 22B. Shafts 23 are inserted into and retained in the opposing shaft slots 22C. The shafts 23 support the rollers 24, and bearings 25 and collars 26.

In each shaft slot 22C, a shaft insertion portion 31 and a shaft retention portion 32 are integrally formed. A slot width of the shaft insertion portion 31 decreases with progress in the downward direction from the conveyance surface 22A. The shaft retention portion 32 extends further in the downward direction from the shaft insertion portion 31. The slot width of the shaft retention portion 32 substantially matches a diameter of a short shaft portion 41 and a long shaft portion 43 of the shaft 23, which are described below.

The shaft slot 22C is also provided with a protrusion portion 33 that protrudes in the upward direction in a circular rod shape from a floor face of the shaft retention portion 32.

In the shaft slot 22C, projection portions 34 are formed at inner sides of the shaft retention portion 32 so as to oppose one another in the conveyance direction. The projection portions 34 are formed at positions that are separated from the floor face of the shaft retention portion 32 by more than the radius of the short shaft portion 41 and long shaft portion 43 of the shaft 23, which are positions at which the projection portions 34 abut against portions of the shaft 23 when the shaft 23 has been inserted and abutted against the floor face of the shaft retention portion 32.

Figure 5:
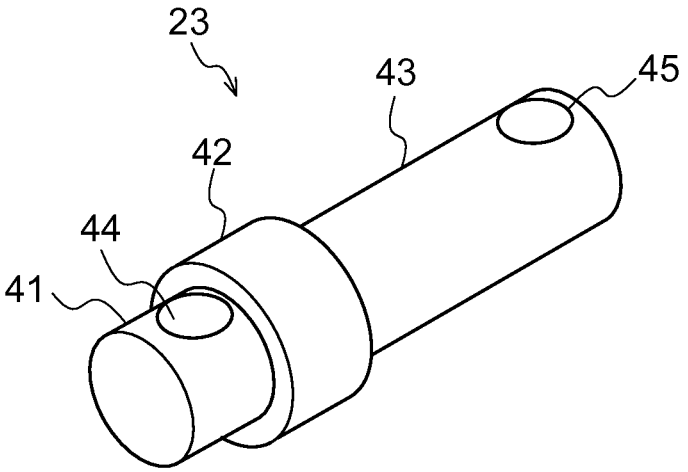
FIG. 5 is a line drawing showing the structure of a shaft in accordance with the first embodiment.
Figure 6A:
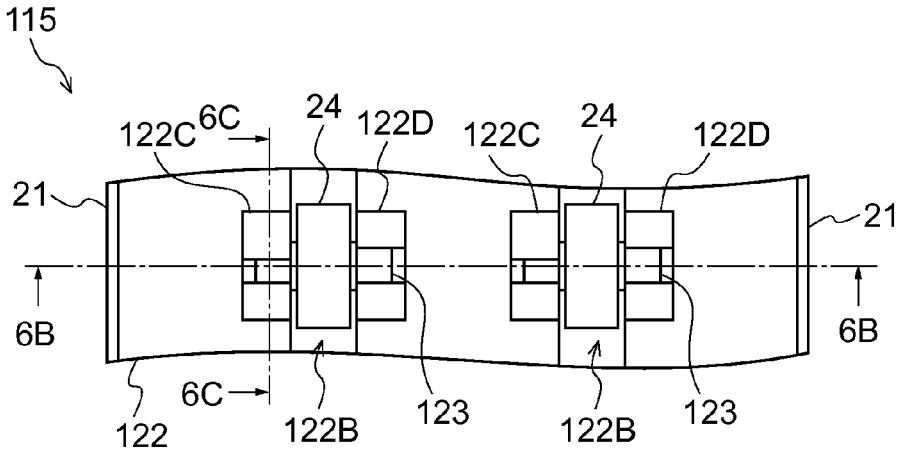
FIG. 6A is a line drawing showing structures of a conveyance path in accordance with a second embodiment.
Figure 6B:
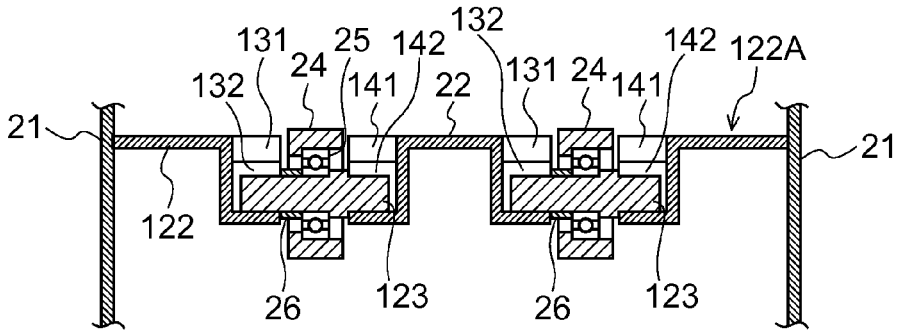
FIG. 6B is a line drawing showing the structures of the conveyance path in accordance with the second embodiment.
Figure 6C:
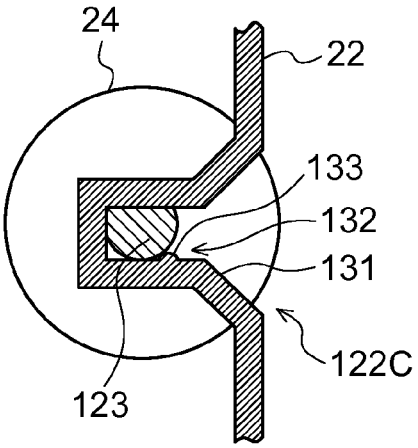
FIG. 6C is a line drawing showing the structures of the conveyance path in accordance with the second embodiment.
Figure 6D:
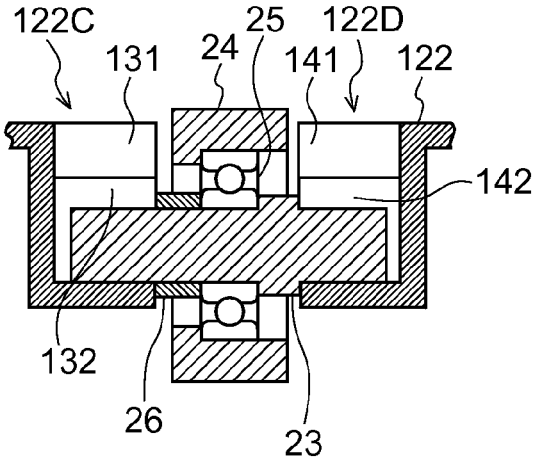
FIG. 6D is a line drawing showing the structures of the conveyance path in accordance with the second embodiment.

As shown in FIG. 5, in each shaft 23, the short shaft portion 41, a large diameter portion 42 and the long shaft portion 43 are integrally formed in circular rod shapes. The short shaft portion 41 and the long shaft portion 43 are formed with diameters that substantially match the slot width of the shaft retention portion 32. Penetrating holes 44 and 45 with diameters larger than the protrusion portion 33 are formed in the short shaft portion 41 and the long shaft portion 43, in the same diametric direction. The large diameter portion 42 is formed with a larger diameter than the short shaft portion 41 and long shaft portion 43.

Each roller 24 is formed in a substantially circular tube shape. The roller 24 is formed with an outer periphery diameter such that a portion of the roller 24 protrudes above the conveyance surface 22A of the guide 22 when the roller 24 is supported at the guide 22 via the shaft 23. A step portion at which an internal diameter is slightly smaller is formed at an inner periphery face of the roller 24. The step portion is provided in order to fix the position of the bearing 25 when the bearing is pushed inside the roller 24 from one side thereof.

The bearing 25 is disposed so as to be in respective contact with the long shaft portion 43 of the shaft 23 and the inner periphery face of the roller 24. The bearing 25 turnably supports the roller 24.

The collar 26 is formed in a circular tube shape whose internal diameter is slightly larger than the diameter of the long shaft portion 43 of the shaft 23. When the shaft 23 is retained in the shaft slots 22C of the guide 22, the collar 26 is disposed between the bearing 25 and the guide 22. The collar 26 is formed with a length that prevents movement of the roller 24 and the bearing 25 in the orthogonal direction.

Each bearing 25 of the conveyance path 15 is pushed into the roller 24, after which the long shaft portion 43 of the shaft 23 is inserted into the bearing 25 until the bearing 25 abuts against the large diameter portion 42. Then the long shaft portion 43 is inserted into the collar 26. Here, such that the roller 24 will not disengage from the bearing 25, the long shaft portion 43 is inserted into the bearing 25 from the opposite side of the bearing 25 from the side thereof at which the step portion is formed, at which the inner periphery face side diameter of the roller 24 is smaller.

The shaft 23 that has been inserted into the roller 24, the bearing 25 and the collar 26 is inserted into the shaft slots 22C of the guide 22 from the side thereof at which the conveyance surface 22A is formed. During this insertion, the protrusion portions 33 of the shaft slots 22C penetrate through the penetrating holes 44 and 45 of the shaft 23.

The shaft 23 is pressed in until the shaft 23 abuts against the floor face of each shaft retention portion 32. Hence, the shaft 23 abuts against the floor face of the shaft retention portion 32 and is nipped between the floor face and the projection portions 34. Because tip portions of the opposingly disposed projection portions 34 are closer than the diameter of the short shaft portion 41 and long shaft portion 43 of the shaft 23, the shaft 23 is prevented from detaching from the shaft slots 22C.

In the conveyance path 15, when the shaft 23 is retained in the shaft slots 22C, a portion of the roller 24 protrudes to the upward direction beyond the conveyance surface 22A of the guide 22, and the protrusion portions 33 penetrate through the penetrating holes 44 and 45. Therefore, the rollers 24 of the conveyance path 15 turn with conveyance of the banknotes BL without the shafts 23 turning together with the turning of the rollers 24.

Thus, because the conveyance path 15 is provided with the shaft slots 22C in the guides 22, the shafts 23 may be made shorter than in a structure in which, as in the related art, the shafts 204 are provided spanning between the frames 201. Therefore, other components may be disposed in spaces to the side of the rollers 24 in the orthogonal direction; for example, sensors may be disposed there and the like.

Furthermore, in the conveyance path 15, the shafts 23 may simply be pushed into the shaft slots 22C. Thus, fastening members such as bolts, pins or the like are not necessary and assembly may be made simpler.

2. Second Embodiment

Figure 7:
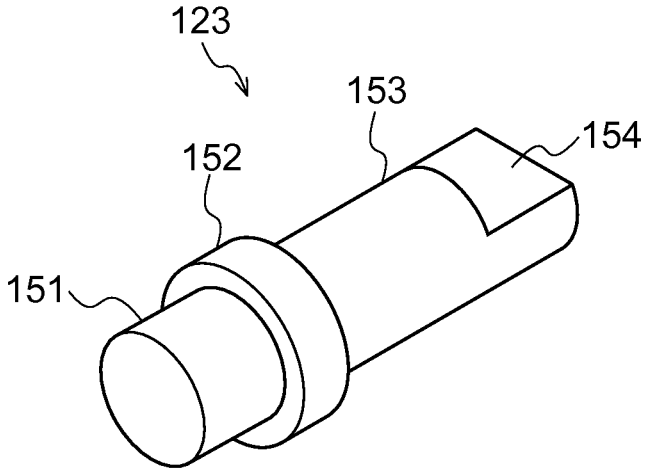
FIG. 7 is a line drawing showing the structure of a shaft in accordance with the second embodiment.
Figure 8A:
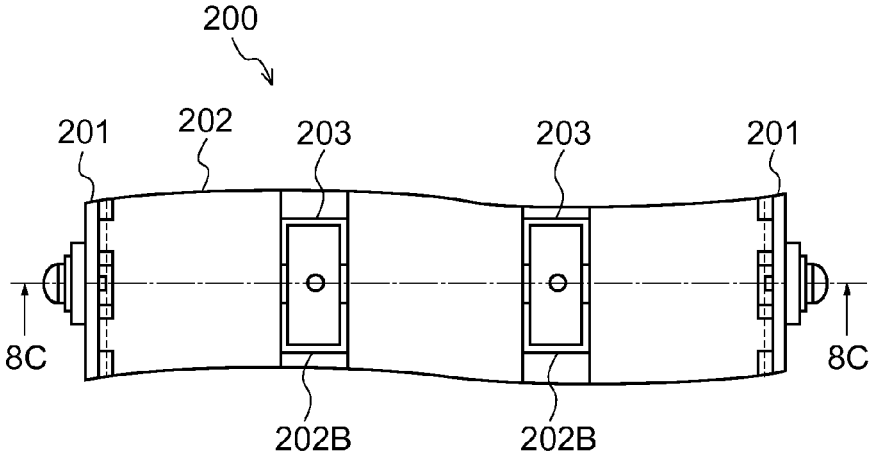
FIG.8A RELATED ART
FIG. 8A is a line drawing showing structures of a related art conveyance path.
Figure 8B:
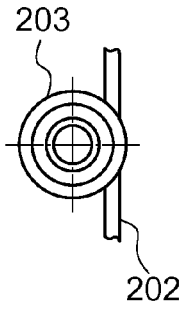
FIG.8B RELATED ART
FIG. 8B is a line drawing showing the structures of the related art conveyance path.
Figure 8C:
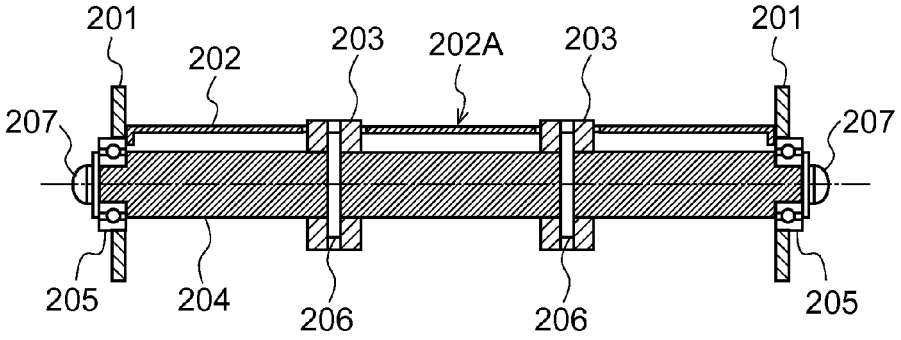
FIG.8C RELATED ART
FIG. 8C is a line drawing showing the structures of the related art conveyance path.
Figure 9:
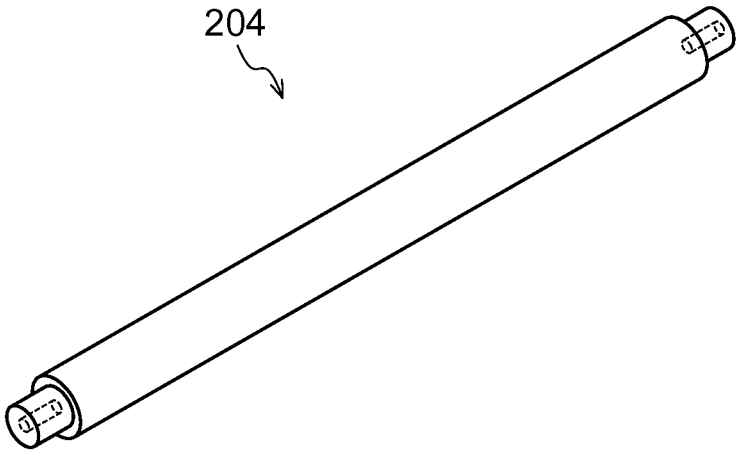
FIG.9 RELATED ART
FIG. 9 is a line drawing showing the structure of a related art shaft.

Now, an ATM 100 according to a second embodiment is described using FIG. 6 and FIG. 7. The ATM 100 according to the second embodiment is provided with a conveyance path 115 instead of the conveyance path 15 of the ATM 1 according to the first embodiment. Other structures are the same as in the ATM 1.

2-1. Structure of the Conveyance Path

As shown in FIG. 6A to FIG. 6D, in which portions corresponding with FIG. 4A to FIG. 4D are assigned the same reference symbols, the conveyance path 115 is provided with the frames 21 along the conveyance direction that are spaced apart so as to oppose one another, matching the long direction length of the banknotes BL.

The conveyance path 115 is provided with thin plate-shaped guides 122 that are fixed so as to span between the opposingly disposed frames 21. The rollers 24, bearings 25 and collars 26 have the same shapes as in the first embodiment.

The conveyance path 115 conveys the banknotes BL on a conveyance surface 122A, which is one face of each guide 122. In the conveyance path 115, recess-shaped roller slots 122B are formed as pairs along the conveyance direction, so as to be sunken in the downward direction toward the face at the opposite side of the guide 122 from the side at which the conveyance surface 122A is provided (to the inside). The rollers 24 are disposed in the roller slots 122B at constant intervals in the conveyance direction.

Shaft slots 122C and 122D are formed in the guide 122 at the positions at which the rollers 24 are disposed. The shaft slots 122C and 122D oppose one another in the orthogonal direction, sandwiching the roller slots 122B. Shafts 123 are fitted into and retained in the opposing shaft slots 122C and 122D. The shafts 123 support the rollers 24 and the bearings 25 and collars 26.

In each shaft slot 122C, a shaft insertion portion 131 and a shaft retention portion 132 are integrally formed. The slot width of the shaft insertion portion 131 decreases with progress in the downward direction from the conveyance surface 122A. The shaft retention portion 132 extends further in the downward direction from the shaft insertion portion 131. The slot width of the shaft retention portion 132 substantially matches a thickness of a D-portion 154 of the shaft 123, which is described below.

In the shaft slot 122C, a projection portion 133 is formed at an inner side of the shaft retention portion 132. The projection portion 133 is formed at a position that is separated from a floor face of the shaft retention portion 132 by more than the radius of a long shaft portion 153 of the shaft 123, which is a position at which the projection portion 133 abuts against a portion of the shaft 123 when the shaft 123 has been inserted and abutted against the floor face of the shaft retention portion 132.

In each shaft slot 122D, a shaft insertion portion 141 and a shaft retention portion 142 are integrally formed. The slot width of the shaft insertion portion 141 decreases with progress in the downward direction from the conveyance surface 122A. The shaft retention portion 142 extends further in the downward direction from the shaft insertion portion 141. The slot width of the shaft retention portion 142 substantially matches the diameter of a short shaft portion 151 of the shaft 123, which is described below.

In the shaft slot 122D, projection portions are formed at the inner sides of the shaft retention portion 142 so as to oppose one another in the conveyance direction. The projection portions are formed at positions that are separated from a floor face of the shaft retention portion 142 by more than the radius of the short shaft portion 151 of the shaft 123, which are positions at which the projection portions abut against portions of the shaft 123 when the shaft 123 has been inserted and abutted against the floor face of the shaft retention portion 132.

As shown in FIG. 7, in each shaft 123, the short shaft portion 151, a large diameter portion 152 and the long shaft portion 153 are integrally formed in circular rod shapes. The short shaft portion 151 is formed with a diameter that substantially matches the slot width of the shaft retention portion 142. The large diameter portion 152 is formed with a larger diameter than the short shaft portion 151 and long shaft portion 153.

The long shaft portion 153 is provided with the D-portion 154, a side face of which is cut flat up to a certain length from the end of the long shaft portion 153 that is at the opposite side thereof from the end at which the large diameter portion 152 is connected. Thus, a cross-sectional shape of the D-portion 154 is a "D" shape. The D-portion 154 is formed such that a thickness thereof from the face that has been cut flat substantially matches the slot width of the shaft retention portion 132.

Each bearing 25 of the conveyance path 115 is pushed into the roller 24, after which the long shaft portion 153 of the shaft 123 is inserted into the bearing 25 until the bearing 25 abuts against the large diameter portion 152. Then the long shaft portion 153 is inserted into the collar 26.

The shaft 123 that has been inserted into the roller 24, the bearing 25 and the collar 26 is inserted into the shaft slots 122C and 122D of the guide 122 from the side thereof at which the conveyance surface 122A is formed. During this insertion, the D-portion 154 of the shaft 123 is inserted into the shaft slot 122C and the short shaft portion 151 is inserted into the shaft slot 122D. The shaft 123 is inserted such that the flat face of the D-portion 154 abuts against an inner face of the shaft retention portion 132 that opposes the inner face at which the projection portion 133 is provided.

The shaft 123 is pressed in until the shaft 123 abuts against the floor faces of the shaft retention portions 132 and 142. Hence, the shaft 123 abuts against the floor faces of the shaft retention portions 132 and 142, the D-portion 154 is nipped between the floor face of the shaft retention portion 132 and the projection portion 133, and the short shaft portion 151 is nipped between the floor face of the shaft retention portion 142 and the projection portions.

A gap between the projection portion 133 and the inner face of the shaft retention portion 132 that opposes the projection portion 133 is narrower than the thickness of the D-portion 154 of the shaft 123. Thus, the shaft 123 is prevented from detaching from the shaft slot 122C.

In the conveyance path 115, the D-portions 154 of the shafts 123 abut against the side faces of the shaft retention portions 142. Thus, the rollers 24 turn with conveyance of the banknotes BL without the shafts 123 turning together with the turning of the rollers 24.

Thus, because the conveyance path 115 is provided with the shaft slots 122C and 122D in the guides 122, the shafts 123 may be made shorter than in a structure in which, as in the related art, the shafts 204 are provided spanning between the frames 201. Therefore, other components may be disposed in spaces to the side of the rollers 24 in the orthogonal direction; for example, sensors may be disposed therein and the like.

In the conveyance path 115, the shafts 123 may simply be pushed into the shaft slots 122C and 122D. Thus, fastening members such as bolts, pins or the like are not necessary and assembly may be made simpler.

In the conveyance path 115, each shaft 123 may be made shorter than in the first embodiment by an amount corresponding to the lack of need for, as in the shaft 23, an increase in the axial direction that is caused by the provision of the penetrating holes 44 and 45.

3. Structures of the ATM According to Alternative Embodiments

In the embodiments described above, cases are described in which the roller slots 22B and 122B are formed continuously in the conveyance direction. The present invention is not limited thus: the roller slots may be formed with lengths only for portions in which the rollers are disposed.

In the embodiments described above, cases are described in which the rollers 24 are disposed so as to be in contact with the banknotes BL. The present invention is not limited thus. For example, the rollers 24 may be connected by a belt to a drive roller that is turned by a motor and, when the drive roller is turned by the motor, the rollers 24 may be turned via the belt so as to convey the banknotes BL.

in the embodiments described above, a case is described in which the banknotes BL are conveyed in a horizontal direction, but the present invention is not limited thus. For example, the present invention is applicable to a case in which the banknotes BL are conveyed in an alternative direction such as a vertical direction or the like.

In the second embodiment described above, a case is described that employs the shaft 123 in which a portion of the side face of the long shaft portion 153 is cut flat to provide the D-portion 154 whose cross-sectional shape is the "D" shape. The present invention is not limited thus. Portions of side faces of the long shaft portion 153 may be cut flat in parallel with one another to form a shape whose cross-sectional shape is an "I" shape. Further, a projection portion may be provided at one of the cut faces and the shaft may be nipped by the projection portion 133.

INDUSTRIAL APPLICABILITY

The present invention may be widely employed in automatic teller machines and devices that convey papers such as banknotes or the like, such as photocopiers, automatic vending machines, ticket machines and so forth.

The disclosures of Japanese Patent Application No. 2012-266261 are incorporated into the present specification by reference in their entirety.

All references, patent applications and technical specifications cited in the present specification are incorporated by reference into the present specification to the same extent as if the individual references, patent Applications and technical specifications were specifically and individually recited as being incorporated by reference.

The invention claimed is:

1. An automatic teller machine, comprising:

a guide that extends in a conveyance direction along which papers are conveyed and that includes a conveyance surface on which the papers are conveyed;

a shaft that is retained at the guide; and a roller that is turnably retained on the shaft, wherein the guide includes:

a roller slot in which the roller is disposed; and a pair of shaft slots opposingly formed with respect to each other to sandwich the roller slot, said pair of shaft slots being recessed from the conveyance surface, the shaft slots respectively retaining two ends of the shaft, wherein the guide includes, in at least one of the shaft slots, a protrusion portion that protrudes in a direction orthogonal to the conveyance surface, the shaft has a longitudinal axis and a through hole, the through hole extending entirely through the shaft and in a direction orthogonal to the longitudinal axis, the protrusion portion is inserted through the through hole to prevent longitudinal axial rotation of the shaft within the shaft slots, when the shaft is retained in the shaft slots, and the guide includes a projection portion that projects in a direction parallel to the conveyance surface from a predetermined position of an inner face of the each shaft slot, the projection portion abutting against the shaft when the shaft is retained in the shaft slots.

2. The automatic teller machine according to claim 1, wherein the projection portion is formed at each of two inner faces of the each shaft slot, the projection portions opposing one another in the conveyance direction.

3. An automatic teller machine, comprising:

a guide that extends in a conveyance direction along which papers are conveyed and that includes a conveyance surface on which the papers are conveyed;

a shaft that is retained at the guide; and a roller that is turnably retained on the shaft, wherein the guide includes:

a roller slot in which the roller is disposed; and a pair of shaft slots opposingly formed with respect to each other to sandwich the roller slot, the shaft slots respectively retaining two ends of the shaft, and wherein:

the guide includes, in at least one of the shaft slots, a protrusion portion that protrudes in a direction orthogonal to the conveyance surface, the shaft has a longitudinal axis and a through hole, the through hole extending entirely through the shaft and in a direction orthogonal to the longitudinal axis, the protrusion portion is inserted through the through hole to prevent longitudinal axial rotation of the shaft within the shaft slots, when the shaft is retained in the shaft slots, and the guide includes a projection portion that projects in a direction parallel to the conveyance surface from a predetermined position of an inner face of the each shaft slot, the projection portion abutting against the shaft when the shaft is retained in the shaft slots.

* * * * *